US010344536B2

(12) United States Patent
Hemph et al.

(10) Patent No.: US 10,344,536 B2
(45) Date of Patent: Jul. 9, 2019

(54) DRILL BIT FOR IMPROVED TRANSPORT OF CUTTINGS

(71) Applicant: SANDVIK INTELLECTUAL PROPERTY AB, Sandviken (SE)

(72) Inventors: Rasmus Hemph, Gavle (SE); Conny Kraft, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/551,681

(22) PCT Filed: Feb. 3, 2016

(86) PCT No.: PCT/EP2016/052278

§ 371 (c)(1),
(2) Date: Aug. 17, 2017

(87) PCT Pub. No.: WO2016/131653

PCT Pub. Date: Aug. 25, 2016

(65) Prior Publication Data

US 2018/0066477 A1 Mar. 8, 2018

(30) Foreign Application Priority Data

Feb. 19, 2015 (EP) ..... 15155777

(51) Int. Cl.
*E21B 10/38* (2006.01)
*E21B 10/567* (2006.01)

(52) U.S. Cl.
CPC ..... *E21B 10/38* (2013.01); *E21B 10/567* (2013.01)

(58) Field of Classification Search
CPC ..... E21B 10/38
USPC ..... 175/417, 418
See application file for complete search history.

(56) References Cited

U.S. PATENT DOCUMENTS

| | | | | |
|---|---|---|---|---|
| 1,515,434 | A * | 11/1924 | Gilman | E21B 10/36 175/400 |
| 3,346,060 | A | 10/1967 | Leaman | |
| 4,051,912 | A | 10/1977 | White | |
| 4,085,809 | A | 4/1978 | Lovell et al. | |
| 4,321,974 | A | 3/1982 | Klemm | |
| 4,716,976 | A | 1/1988 | Isakov | |
| 5,358,063 | A | 10/1994 | Hedlund et al. | |
| 5,435,401 | A | 7/1995 | Hedlund et al. | |
| 6,035,953 | A * | 3/2000 | Rear | E21B 7/208 175/171 |
| 6,789,632 | B2 | 9/2004 | Green | |
| 2010/0108398 | A1 | 5/2010 | Niu | |

FOREIGN PATENT DOCUMENTS

| | | | |
|---|---|---|---|
| CN | 101023240 | A | 8/2007 |
| WO | 93/06332 | A1 | 4/1993 |

* cited by examiner

*Primary Examiner* — Janine M Kreck
*Assistant Examiner* — Brandon M Duck
(74) *Attorney, Agent, or Firm* — Corinne R. Gorski

(57) ABSTRACT

A rock drill bit includes a head provided at one end of an elongate shank. A plurality of fluid flushing passageways extend axially from an internal bore extending through the shank with at least one fluid flushing passageway having an exit end at the front face formed as an elongate slot having a length greater than a width to facilitate the rearward transport of cut rock fragment.

14 Claims, 6 Drawing Sheets

DRILL BIT FOR IMPROVED TRANSPORT OF CUTTINGS

RELATED APPLICATION DATA

This application is a § 371 National Stage Application of PCT International Application No. PCT/EP2016/052278 filed Feb. 3, 2016 claiming priority of EP Application No. 15155777.4 filed Feb. 19, 2015.

FIELD OF INVENTION

The present invention relates to a drill bit and in particular, although not exclusively, to a percussive drill bit formed with a cutting head having an elongate slot at a front face of the bit for the exhaust of a flushing fluid.

BACKGROUND ART

Percussion drill bits are widely used both for drilling relatively shallow bores in hard rock and for creating deep boreholes. For the latter application, drill strings are typically used in which a plurality of rods are interconnected to advance the drill bit and increase the depth of the hole. In 'top hammer drilling' a terrestrial machine is operative to transfer a combined impact and rotary drive motion to an upper end of the drill string whilst a drill bit positioned at the lower end is operative to crush the rock and form the boreholes. In down-the-hole hammer (DTH) drilling the impact is delivered not through the upper end of the string, but by a hammer directly connected to the drill bit within the hole.

Fluid is typically transported through the drill string and exits at the base of the borehole via passageways in the drill head to flush the rock cuttings from the boring region to be conveyed backward around the outside of the drill string. Examples of percussive drill bits are disclosed in U.S. Pat. Nos. 3,346,060; 4,051,912; US 2010/0108398; WO 93/06332; U.S. Pat. Nos. 4,716,976 and 6,789,632.

Conventionally, the exit end of the flushing passageways are circumferentially spaced apart at the front face and comprise circular cross sectional profiles. In some instances the passageways emerge within grooves recessed at the front face to facilitate the radially outward and axially rearward transport of the cut rock fragments. However, existing drill bits are disadvantageous in that certain regions of the front face do not receive the flushing fluid and are therefore susceptible to debris accumulation. This reduces the forward drilling rate and increases the frictional wear of the bit and in particular the cutting inserts. Accordingly, what is required is a drill bit that addresses these problems.

SUMMARY OF THE INVENTION

It is an objective of the present invention to provide a drill bit and in particular a percussive down-the-hole hammer (DTH) bit that is optimised for drilling efficiency and in particular for maximised penetration rate and minimised frictional wear at the bit. It is a further specific objective to provide a drill bit that is effective to facilitate the axially rearward flushing of rock debris.

The objectives are achieved by providing a drill bit having a fluid flushing passageway exiting at the axially forward cutting face of the bit head that increases the delivery of the flushing fluid to all regions and in particular the radial centre of the head. In particular, the fluid exit end of the flushing passageway at the front face is formed as an elongate slot having a length that is appreciably larger than a width.

According to a first aspect of the present invention there is provided a rock drill bit head provided at one end of an elongate shank having an internal bore extending axially from one end of the shank to the head, the head comprising: an axially forward facing front face; a plurality of cutting inserts provided at the front face; at least one fluid flushing passageway extending axially from the internal bore towards the front face; characterised in that: a fluid exit end of the passageway at the front face is formed as an elongate slot having a length greater than a width in a radial direction of the front face.

Within the specification, reference to an 'elongate slot' encompasses an exit end of a passageway that comprises a length that is greater than a corresponding width in a radial direction of the bit (perpendicular to the bit longitudinal axis). This term also encompasses a plurality of individual passageways that exit at the front face of the head in close side-by-side alignment along a diameter of the bit head such that collectively the individual exit apertures of the passageways define a slot. In such embodiments, the slots are separated from one another by a distance that is less than a diameter of each exit end of each individual passageway.

Preferably, the slot is formed as a single opening being the exit end of a single fluid flushing passageway that extends axially between the forward facing front face of the head and the internal bore extending axially within the shank and a part of the head. Preferably, a lengthwise centre of the slot is less than a width of the slot at the slot ends. Optionally, the width of the slot at its lengthwise centre may be in a range 20 to 95% of a width of the slot at each respective ends. Such a configuration is advantageous to direct the flushing fluid towards the slot ends such that the majority of the fluid exits the passageway towards the slot ends. This provides a controlled and desired flow of flushing fluid (typically air) from the central passageway to be distributed over the head. Where the slot is positioned centrally at the head, such an arrangement is advantageous to 'clean' the central region of the head and to expel radially outward and axially rearward rock fragments from the forwardmost cutting region of the head.

Preferably, the lengthwise ends of the slot comprise a rounded shape profile. The rounded ends preferably taper into the lengthwise edges of the slot to provide a smooth curving profile at the length ends. This is advantageous to reduce turbulence as the air exits the slot so as to direct the fluid in the desired fluid flow path.

Preferably, the length of the passageway in a radial direction increases in the axial direction from the internal bore within the shank to the front face such that a pair of end walls that define the lengthwise ends of the slot are aligned transverse to the axis of the bit. Accordingly, the slot may be formed as V-shaped groove recessed into the front face with the base of the groove provided in fluid communication with the internal bore. The central passageway therefore may considered to be a wedge-shaped cavity emerging at the front face as an elongate slot. Optionally, an angle by which each of the end walls extend relative to the axis is in the range 5 to 85°, 5 to 60°, 15 to 40° and more preferably 20 to 30°. The transverse or inclined end walls are advantageous to direct the flushing fluid to exit the passageway towards the lengthwise ends of the slot to achieve the desired fluid flow over the front face.

Optionally, the slot may be generally dumbbell-shaped and comprise lengthwise end edges (at the front face) that are curved and devoid of angled sections that would otherwise disrupt the flow of the flushing fluid and induce undesirable turbulence. The present slot configuration therefore is optimised for the radially outward and axially rearward transport of cut rock fragments from the front face. According to further specific implementations, the slot may be generally rectangular and have rounded or curved corners.

Preferably, the pair of sidewalls that define the lengthwise sides of the slot are curved inwardly in a radial direction from the slot ends towards the lengthwise centre of the slot. The sidewalls may therefore bow radially inward towards the axial centre of the bit. Such an arrangement is advantageous to facilitate the directing of the fluid towards the ends of the slot such that the majority of the fluid flows towards the slot ends and not through the slot centre.

Preferably, the bit head further comprises at least one satellite fluid flushing passageway extending axially from the internal bore towards and exiting at the front face at a lateral lengthwise side of the slot. Preferably, the bit comprises two satellite passageways positioned at both the lengthwise lateral sides of the slot. Preferably, a shape profile of the exit ends of the satellite passageways is generally circular at the front face in a plane perpendicular to an axis of the bit. Optionally, a diameter of the exit ends of the satellite passageways may be in the range of approximately half to double the diameter of the gauge inserts positioned at the perimeter edge of the bit head. The single central slot and satellite passageways are advantageous to collectively exhaust the fluid at the front face so that substantially all of the front face receives the flushing fluid. Accordingly, all of the cutting inserts are capable of being 'cleaned' by the flushing fluid to avoid any regions that would otherwise be subject to debris accumulation and the accelerated wear of the cutting inserts and to maximise the operational forward drilling rate.

Preferably, the head comprises a pair of front cutting inserts positioned to each of the respective lengthwise sides of the slot, wherein respective cutting tips of the front cutting inserts are positioned forwardmost at the drill bit. The front cutting inserts optionally comprise a diameter less than the gauge inserts and are optionally aligned across the diameter of the front face and in-line with the two exit ends of the satellite passageways. Preferably, the exit ends of the passageways and the two front inserts are aligned on a diametric spoke that extends perpendicular to the alignment of the elongate slot.

Positioning two front inserts at both the lengthwise sides of the slot is advantageous to ensure the innermost front cutting inserts receive large volumes of flushing fluid so that they are constantly cleaned and the rock fragments continually swept radially outward and axially rearward from the inner front face region. The present bit therefore is optimised for reducing wear of the cutting inserts and maximising the forward penetration rate due to its optimised front face cleaning capacity.

Preferably, the bit further comprises flushing grooves recessed in the front face and extending radially outward from and in communication with the lengthwise ends of the slot. The bit head further comprises a single groove extending diametrically across the front face with the central slot forming a component part of the single groove. Preferably, the groove is elongate and comprises first and second ends that are provided in fluid communication with perimeter sludge grooves that are recessed radially into the perimeter edge/wall of the bit head and extend axially rearward from the front face to a skirt and the shank. The slot and the groove arrangement is advantageous to facilitate the radially outward and axially rearward transport of rock fragments.

Preferably, the front face is axially crowned such that a radial centre of the front face is positioned axially forward relative to a perimeter of the front face. The front face therefore may comprise a domed shaped profile in which a central radially inner region is positioned axially forward relative to a gauge perimeter region of the head. Optionally, the head and in particular the front face may be considered to comprise a plurality of concentric annular regions including an outer gauge region, an inner central region and a plurality of intermediate annular regions positioned radially between the inner region and the gauge region. The different annular regions of the front face may be aligned perpendicular and transverse to the longitudinal axis of the bit so that collectively these regions define the crowned or domed front face. Such an arrangement is advantageous to direct the rock fragments axially rearward and to avoid accumulation of the fragments at the front face.

Optionally, the width of the slot is in a range 2 to 20%, 4 to 18% and more preferably 7 to 16% of the length of the slot. Optionally, the length of the slot is in the range 20 to 80%, 25 to 75% or more preferably 30 to 60% of a diameter of the front face as defined by the perimeter edge of the front face. Such dimensions are advantageous to achieve the desired flow of fluid (predominantly from the lengthwise ends of the slot) and to deliver the fluid to all regions of the front face.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
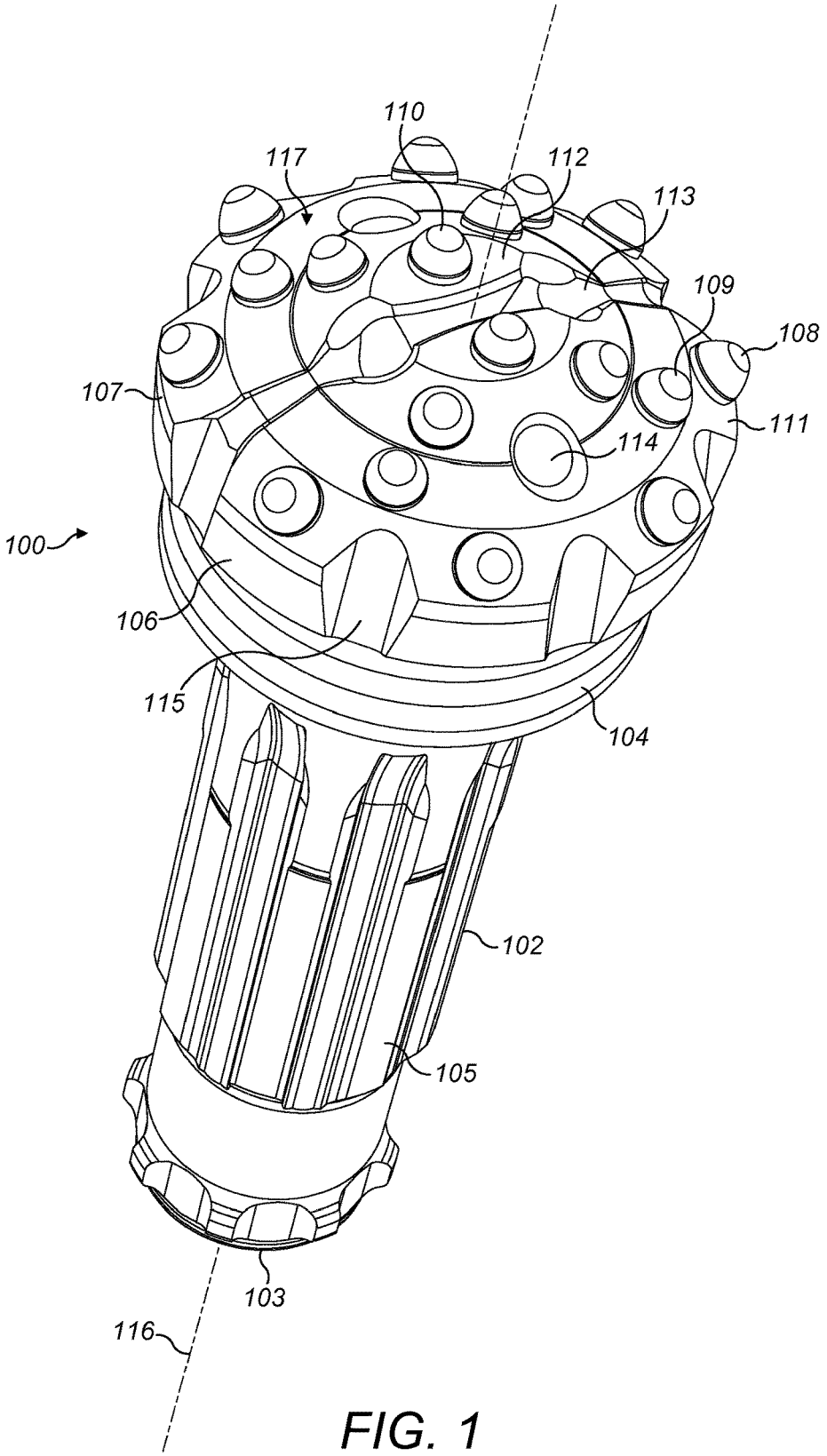
FIG. 1 is an external perspective view of a drill bit having a head provided at one end of an elongate shank with a centrally positioned fluid flushing slot provided at the front face of the head according to a specific implementation of the present invention.
Figure 2:
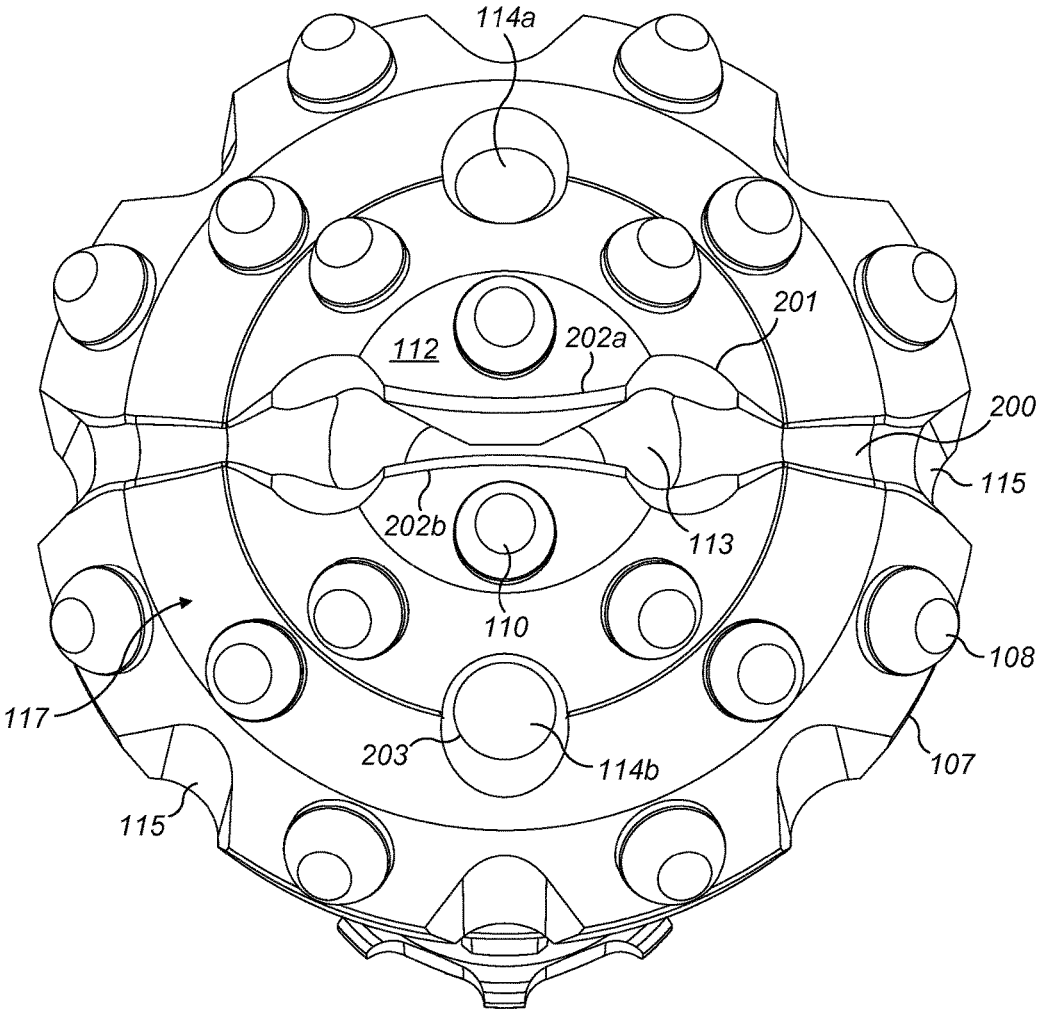
FIG. 2 is a magnified perspective view of the front face of the bit head of FIG. 1.

FIG. 1 is an external perspective view of a down-the-hole hammer (DTH) drill bit comprising a bit head indicated generally by reference 100 positioned at one end an elongate shank 102. Shank 102 comprises axially extending splines 105 aligned parallel to a longitudinal axis 116 of the drill bit. Head 100 is provided at a first end of shank 102 whilst a second end 103 comprises an annular rearward facing end face for contact by a reciprocated piston (not shown) within the DTH assembly. Head 100 comprises an axially rearward annular skirt 104 that provides a transition from head 100 into shank 102 with the head 100, skirt 104 and shank 102 formed integrally.

Head 100 comprises a front face indicated generally by reference 117 having a generally circular perimeter edge 107. Front face 117 is divided radially into a radially outermost gauge region 111 positioned radially closest to perimeter edge 107 and an innermost region 112 positioned radially centrally at front face 117. Head 100 and in particular front face 117 is crowned such that the central front face region 112 is positioned axially forward of the gauge region 111.

A plurality of hardened cutting inserts are distributed over front face 117 and include a set of gauge inserts 108 circumferentially spaced at the gauge face region 111. A plurality of front inserts 109 are positioned radially inside gauge inserts 108 and a pair of axially forwardmost front inserts 110 are positioned at the inner central region 112. According to the specific implementation, head 100 comprises two inner front inserts 110, a first set of four front inserts 109, a second set of four front inserts 109 and eight gauge inserts 108. Referring to figured 1 to 3, head 100 also comprises a plurality of fluid flushing passageways that extend axially forward from a central bore 300 that extends axially through shank 102 from second end 103 to the head 100. According to the specific implementation, head 100 comprises three fluid flushing passageways, a first passageway indicated generally by reference 113 is formed as an elongate slot and is positioned centrally at front face 117. A first and second satellite passageway 114*a*, 114*b* are positioned at each lateral lengthwise side of central slot 113 and comprise an exit end 203 (positioned at front face 117) that is substantially circular in a plane perpendicular to axis 116. Each satellite passageway 114*a*, 114*b* is positioned approximately at a respective mid-radius position between each lengthwise side of slot 113 and front face perimeter edge 107.

Figure 3:
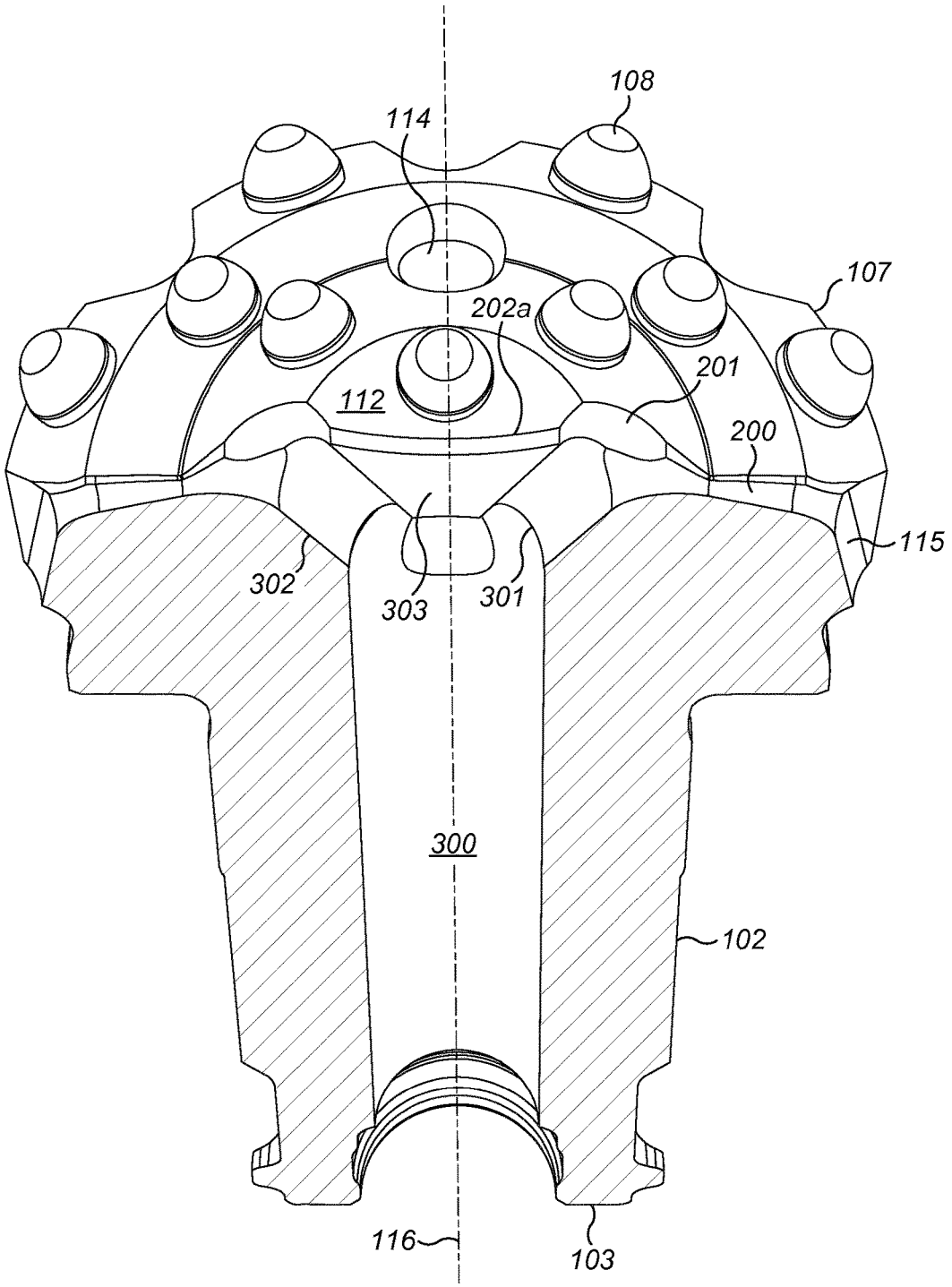
FIG. 3 is a perspective cross sectional view of the bit head and shank of FIG. 1.
Figure 4:
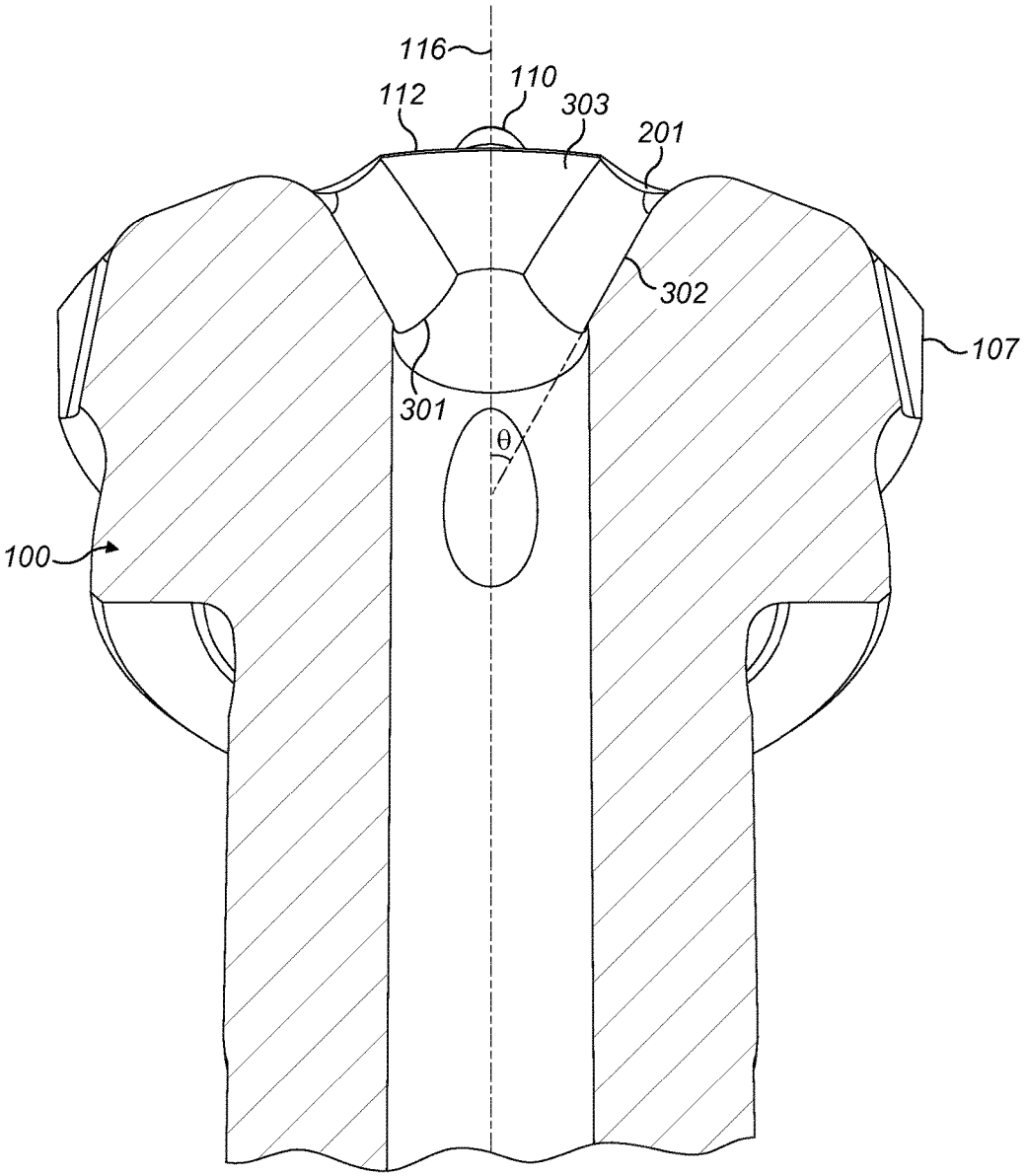
FIG. 4 is a further axial cross sectional view of the bit head and shank of FIG. 1.

Slot 113 is defined at front face 117 by a pair of opposed lengthwise extending edges 202*a*, 202*b*. Edges 202*a*, 202*b* represent the leading edge of lengthwise extending slot sidewalls 303 that extend from an axially forwardmost end 301 of central bore 300 to the front face 117. Slot 113 is also defined by a pair of generally rounded ends 201 that may be considered to be dish-shaped and recessed into front face 117 at the ends of lengthwise edges 202*a*, 202*b*. Slot 113 is further defined by a pair of end walls 302 that also extend axially between the forwardmost end 301 of bore 300 and front face 117. Referring to FIGS. 3 and 4, end walls 302 are aligned transverse to axis 116 and in particular each wall 302 projects radially outward from axis 116 by an angle θ in the range 5 to 50° and in particular 20 to 40°. Accordingly, and referring to the cross sectional views of FIGS. 3 and 4, in an axial direction, slot 113 is formed as a V-shaped groove projecting axially rearward from front face region 112 such that the axially rearwardmost part of the groove is provided in fluid communication with central bore 300.

Figure 5:
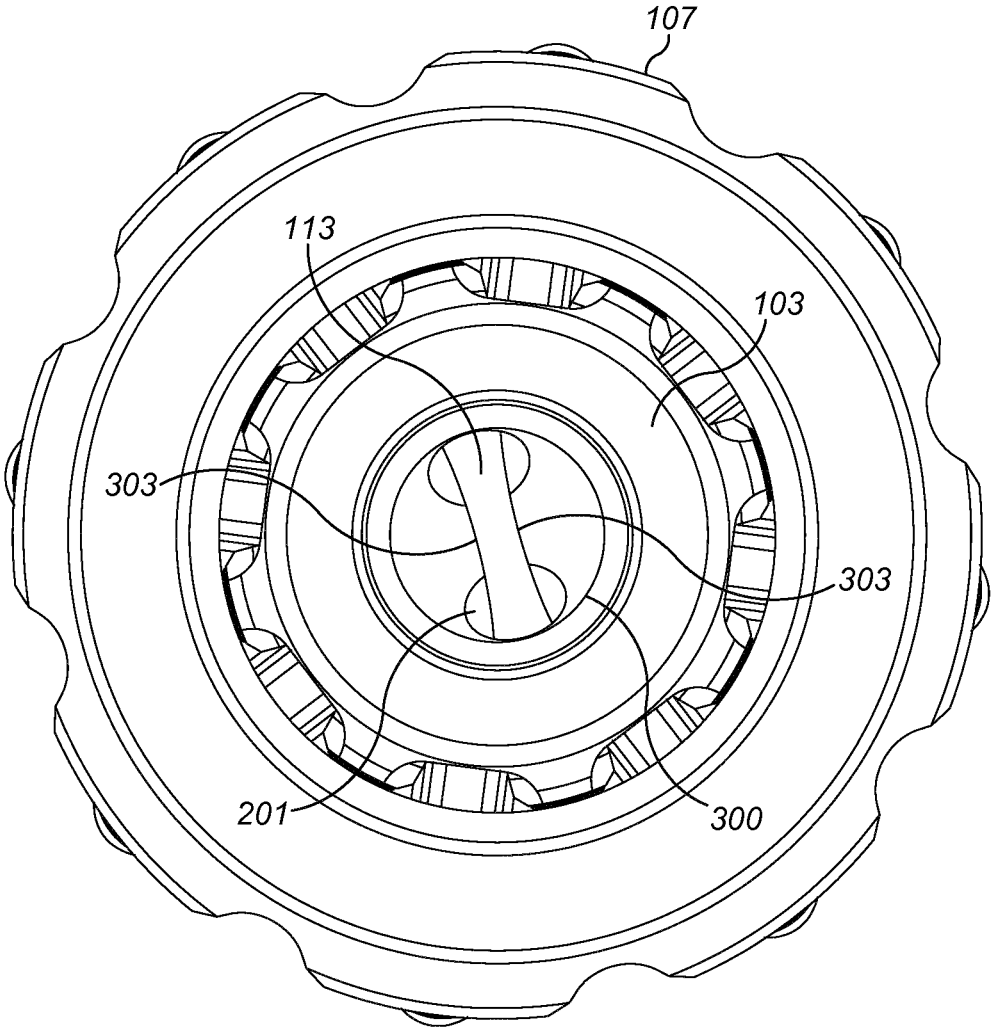
FIG. 5 is an end view of the bit head and shank of FIG. 1.

According to the specific implementation, the innermost front inserts 110 are positioned at each lateral side of the lengthwise edges 202*a*, 202*b* and are also positioned directly radially inside of the satellite fluid flushing passageways 114*a*, 114*b*. According to the specific implementation, lengthwise walls 303 and lengthwise edges 202*a*, 202*b* are curved or bowed radially inward such that a mid-length central region of slot 113 comprises a width being less than a corresponding width at each lengthwise end 201 as illustrated in FIG. 5. According to the specific implementation, slot 113 may be considered to comprise a 'dumbbell' shape in a plane perpendicular to axis 116.

A plurality of perimeter flushing grooves 115 are recessed radially into an annular outer wall 106 of head 100 extending rearwardly from perimeter edge 107. Perimeter grooves 115 also extend axially rearward from front face 117 to skirt 104. A respective front groove 200 is also recessed into front face 117 to extend radially between each slot end 201 and respective perimeter grooves 115. Accordingly, a single groove (or channel) extends across the full diameter of front face 117 between diametrically opposed perimeter grooves 115 with the single groove comprising central slot 113 and the front and perimeter grooves 200, 115. A depth of the single groove (or channel) across the front face increases towards its radial centre (at slot 113) via the angular aligned end walls 302 being declined from front face 117 towards and communicating with central bore 300. Accordingly, a length of slot 113 (in a plane perpendicular to axis 116) increases in the axial direction from the bore end 301 to the front face 117.

Figure 6:
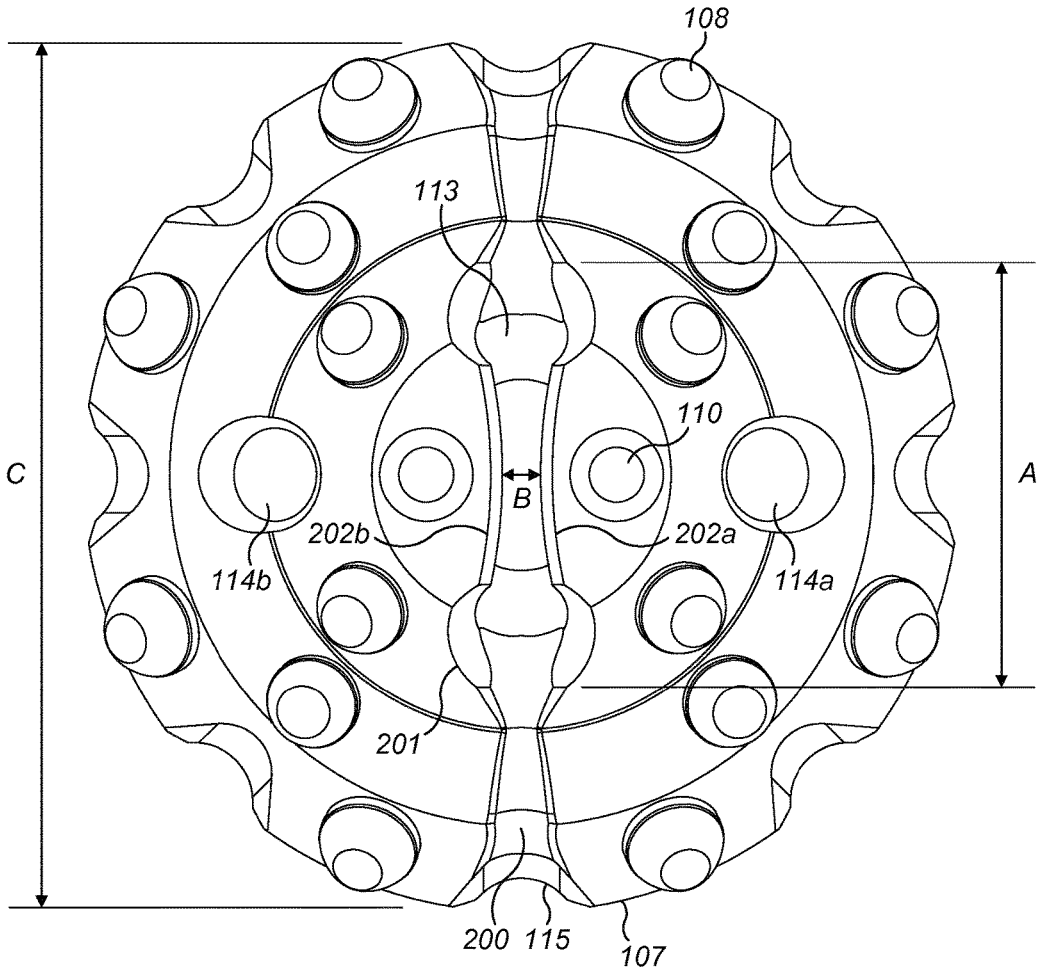
FIG. 6 is an end view of the bit head of FIG. 1.

In particular, and referring to FIG. 6, a length A of slot 113 in a radial direction perpendicular to axis 116 is defined as the distance between each of the forwardmost ends of the end walls 302 where these end walls 302 intersect the front face 117. A width of slot 113 is represented by reference B at the slot centre corresponding to the mid-length region of length A. A diameter of the front face 117 corresponding to the distance across front face 117 from perimeter edge 107, perpendicular to axis 116, is represented by reference C. According to the specific implementation, the width of the slot B at its centre is in the range 5 to 20% of the slot length A and approximately 2 to 6% of the head diameter C. Slot length A is also less than a separation distance between the exit ends of the satellite passages 114*a*, 114*b* in a plane perpendicular to bit axis 116. Slot length A is also approximately 30 to 60% of the bit head diameter C according to the specific implementation.

According to further specific implementation, slot 113 may be formed by a plurality of individual passageways extending axially between inner front face region 112 and central bore 300. The exit ends of the passageways are aligned across the diameter of the front face and are positioned in near touching contact side-by-side to form a series of passageways (apertures) that collectively define an effective single 'slot'. According to a further specific implementation, the head may comprise five central passageways to form the central slot 113 together with two satellite passageways 114*a*, 114*b* as described with reference to FIGS. 1 to 6.

The invention claimed is:

1. A rock drill bit head provided at one end of an elongate shank having an internal bore extending axially from one end of the shank to the head, the head comprising:

an axially forward front face;

a plurality of cutting inserts provided at the front face;

at least one fluid flushing passageway extending axially from the internal bore towards the front face; and a fluid exit end of the passageway at the front face formed as an elongate slot having opposed lengthwise ends and a pair of sidewalls that define lengthwise sides of the slot, the elongate slot having a length, the length of the slot being greater than a width of the slot in a radial direction of the front face, the pair of sidewalls that define the lengthwise sides of the slot being curved inwardly in a radial direction from the slot ends towards a lengthwise centre of the slot.

2. The bit head as claimed in claim 1, wherein a width of the slot at a lengthwise centre of the slot is less than a width of the slot at the slot ends.

3. The bit head as claimed in claim 1, wherein the lengthwise ends of the slot have a rounded shape profile.

4. The bit head as claimed in claim 1, wherein the length of the fluid flushing passageway in a radial direction increases in the axial direction from the internal bore within the shank to the front face such that a pair of end walls that define the lengthwise ends of the slot are aligned transverse to the axis of the bit.

5. The bit head as claimed in claim 4, wherein an angle by which each of the end walls extend relative to the axis is in the range 5 to 85°.

6. The bit head as claimed in claim 1, wherein the slot has a dumbbell shape.

7. The bit head as claimed in 1, further comprising at least one satellite fluid flushing passageway extending axially from the internal bore towards and exiting at the front face at a lateral lengthwise side of the slot.

8. The bit head as claimed in claim 7, comprising two satellite fluid flushing passageways, each fluid flushing passageway being positioned at a respective lengthwise lateral side of the slot.

9. The bit head as claimed in claim 1, comprising a pair of front cutting inserts positioned at each of the respective lengthwise sides of the slot, wherein respective cutting tips of the front cutting inserts are positioned forwardmost at the drill bit.

10. The bit head as claimed in claim 1, further comprising flushing grooves recessed in the front face and extending radially outward from and in communication with the lengthwise ends of the slot.

11. The bit head as claimed in claim 1, wherein the front face is axially crowned such that a radial centre of the front face is positioned axially forward relative to a perimeter of the front face.

12. The bit head as claimed in claim 1, wherein the slot is positioned at a radial centre of the front face.

13. The bit head as claimed in claim 1, wherein the width of the slot is in a range 2 to 20% of the length of the slot.

14. The bit head as claimed in claim 1, wherein the length of the slot is in a range 20 to 80% of a diameter of the front face.

* * * * *